United States Patent [19]

Smith et al.

[11] Patent Number: 4,865,721

[45] Date of Patent: Sep. 12, 1989

[54] VERTICAL-DROP GRAIN ASPIRATOR

[75] Inventors: Charles A. Smith, Zimmerman; Donald Deane, Minnetonka, both of Minn.

[73] Assignee: Carter-Day Company, Minneapolis, Minn.

[21] Appl. No.: 117,801

[22] Filed: Nov. 5, 1987

[51] Int. Cl.[4] ..... B07B 4/00

[52] U.S. Cl. ..... 209/135; 209/137; 209/149

[58] Field of Search ..... 209/135, 134, 133, 132, 209/149, 136, 137

[56] References Cited

U.S. PATENT DOCUMENTS

| | | | |
|---|---|---|---|
| 2,493,218 | 1/1950 | Bergstrom | 209/135 X |
| 4,354,641 | 10/1982 | Smith | 209/137 X |
| 4,568,453 | 2/1986 | Lowe, Jr. | 209/135 |

*Primary Examiner*—Joseph J. Rolla
*Assistant Examiner*—David H. Bollinger
*Attorney, Agent, or Firm*—Dorsey & Whitney

[57] ABSTRACT

An aspirator and method for separating fines and foreign matter from dry, free-flowing granular material, characterized by a vertical drop of the unclean granular material in a separation plenum into an opposing upward air stream and a plurality of vertically-spaced, horizontally-extending transverse air streams. Suspended fines and foreign matter are conducted from the granular material in the separation plenum through a plurality of vertically-spaced outlets into a manifold for discharge from the aspirator. The apparatus and method avoid bunching, recompaction and congregating of the granular material during the separation process, to thereby increase throughput and optimize separation efficiency.

14 Claims, 2 Drawing Sheets

VERTICAL-DROP GRAIN ASPIRATOR

SUMMARY OF THE INVENTION

The invention is an aspirator and method for separating fines and/or foreign matter from dry, free-flowing granular material such as cereal grains, oilseeds, plastics, fertilizer, legumes, rice and peanuts.

The apparatus is designed to provide for, and the method is characterized by, an unimpeded free-fall, vertical flow path or stream of granular material, an opposing vertical air stream and a plurality of vertically-spaced, transverse air streams that cross the vertical flow path. Fines and foreign matter are suspended and conducted from the stream or flow path of granular material, and discharged. The clean granular material, free of the separated fines and/or foreign matter, is collected at the lower end of the flow path.

The apparatus of the invention includes a charging hopper and discharge means disposed vertically beneath the charging hopper for conducting the granular material from the apparatus. A separation plenum extends vertically downwardly from the charging hopper to the discharge means. An air outlet manifold extends substantially the entire length of the separation plenum on one side. A plurality of vertically-spaced, horizontally-extending air inlets is defined by the side wall of the separation plenum opposite the air outlet manifold, thereby providing a plurality of air inlets into the separation plenum. A corresponding plurality of horizontally-extending, vertically-spaced air outlets are defined by the side wall of the separation plenum opposite the inlets, adjacent to the air outlet manifold. The air outlets are disposed opposite and above the inlets, repectively, and provide for a plurality of air streams transverse to the vertical flow path of the granular material as well as an upwardly vertical air stream, which opposes the downward vertical flow path of the granular material.

The method comprises dropping the unclean granular material in a vertical flow path, providing an opposing, substantially upward air stream in the flow path substantially the entire length of the flow path, to thereby suspend fines and foreign matter in the flow path, providing a plurality of vertically-spaced, substantially horizontal air streams extending transversely across the flow path and conducting the suspended fines and foreign matter from the flow path at a corresponding plurality of spaced points offset from the flow path in the direction of the substantially horizontal air stream immediately beneath each of said points, and collecting the clean granular material in the flow path below the transverse air streams.

The object of the invention is to provide an apparatus and method for separating fines and foreign matter from free flowing granular material with maximum efficiency and speed. An unimpeded vertical drop or flow path of the unclean granular material is used, thereby avoiding bunching, congregating and recompaction of the material, which occurs in conventional "zig-zag" separators in which the granular material is supported on spaced, opposed inclined plane surfaces in the course of flowing over a zig-zag flow path.

In the course of travel along the unimpeded vertical flow path, the granular material is subjected to a substantially constant upward opposing air stream and a plurality of spaced transverse air streams, which conduct the suspended fines and foreign material from the flow path, thereby separating the fines and foreign matter from the granular material.

DETAILED DESCRIPTION

Apparatus

Figure 1:
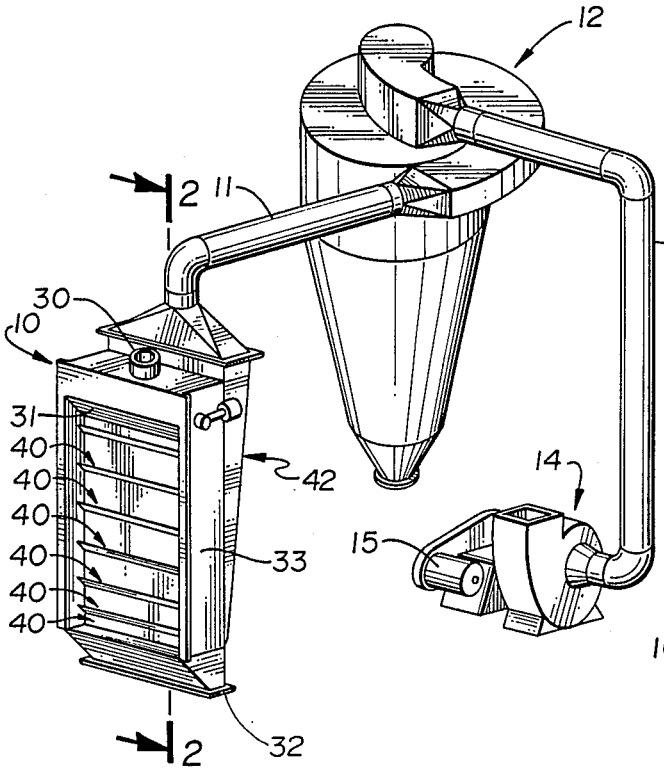
FIG. 1 is a perspective view of the vertical drop grain aspirator of the present invention in an open system in which the air outlet of the aspirator is connected to a cyclone type dust collector. A motor and blower are also shown.

The aspirator 10 of the present invention is shown in an open system in FIG. 1. The air outlet 11 of aspirator 10 is connected to a cyclone-type dust collector 12, the outlet 13 of which is connected to blower 14, which is powered by motor 15.

Figure 4:
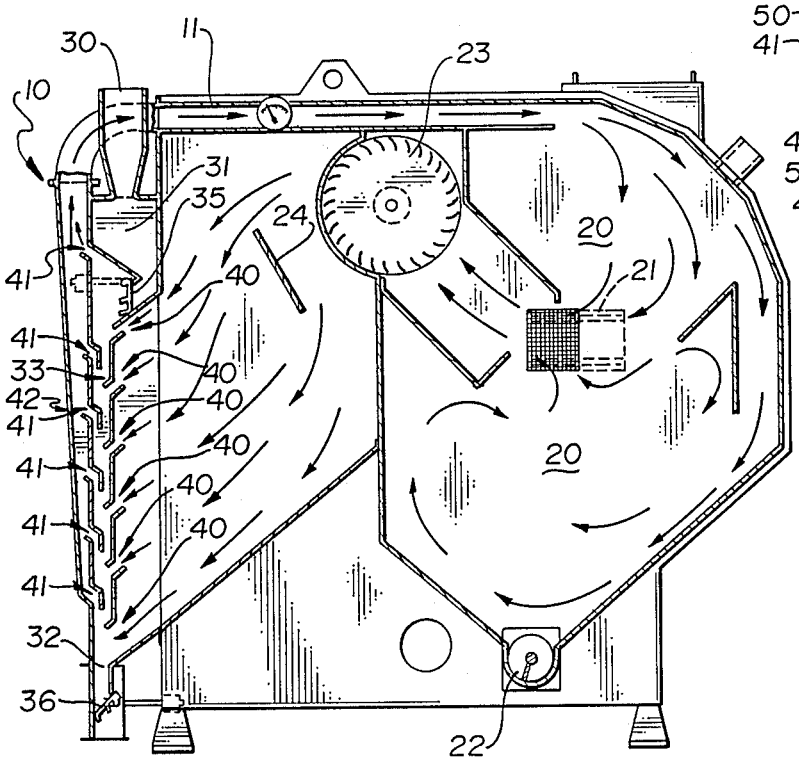
FIG. 4 is a vertical sectional view of the aspirator of the present invention in a closed system in which the air outlet of the aspirator is connected to a blower intake and settling chamber with the air inlets of the aspirator in communication with the blower discharge.

In FIG. 4, aspirator 10 is shown in a closed system in which aspirator air outlet 11 communicates with a settling chamber 20, which includes a guard screen 21, solids conveyor 22 and blower 23. The discharge side of blower 23 communicates around a baffle plate 24 with the inlet side of aspirator 10. Arrows in FIG. 4 show the direction of air flow.

Figure 2:
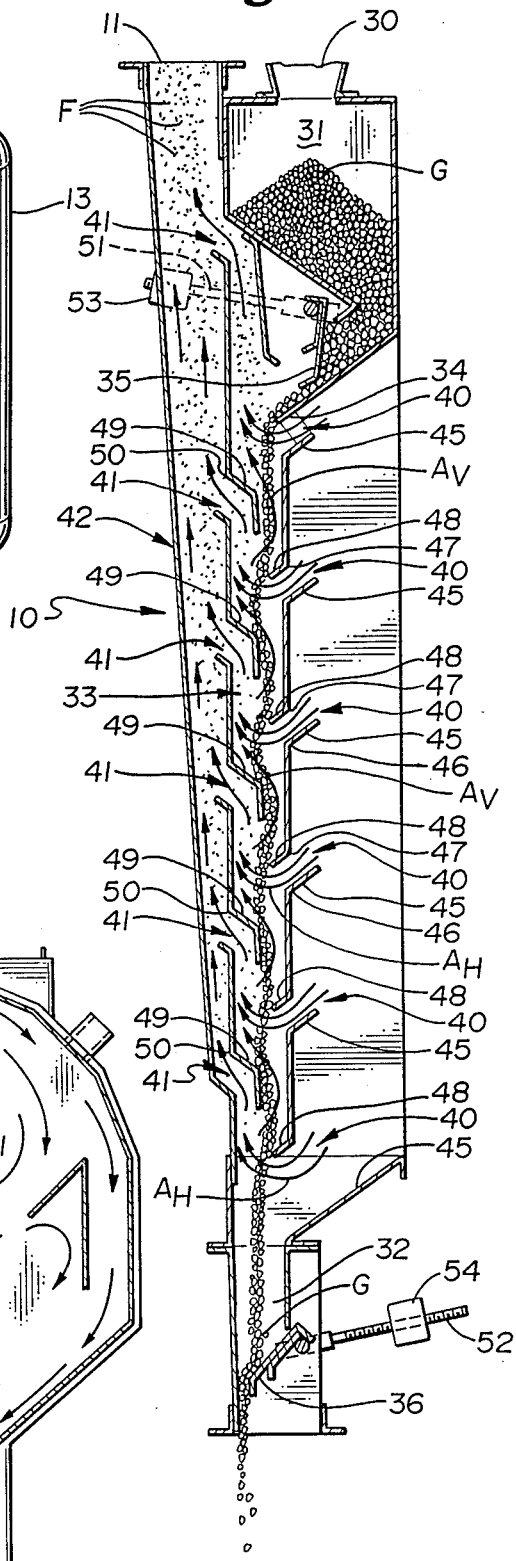
FIG. 2 is a vertical sectional view of the aspirator of FIG. 1, taken on the line 2—2 of FIG. 1.
Figure 3:
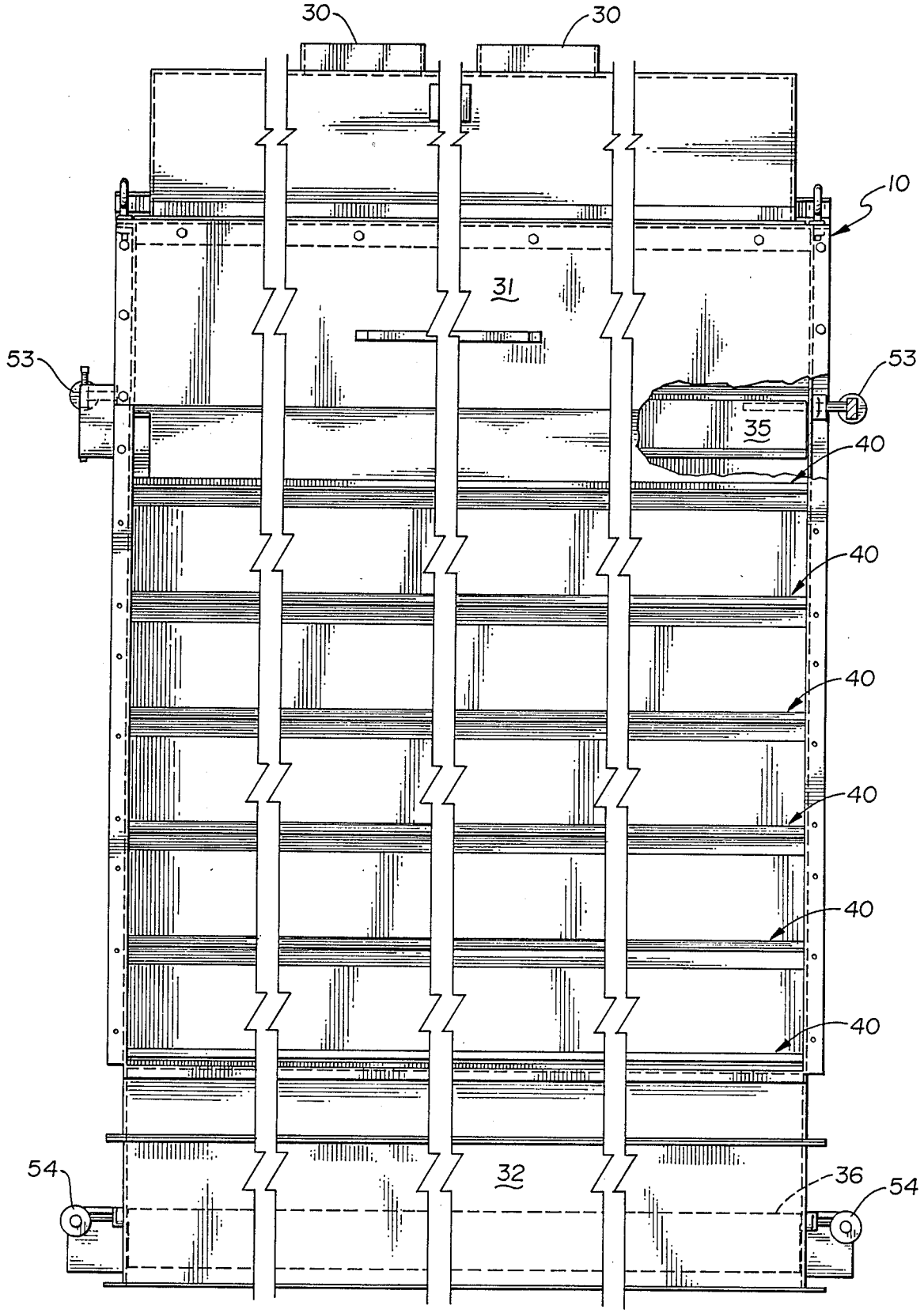
FIG. 3 is a side view of the air intake side of the aspirator of FIG. 1, broken vertically to indicate that the width of the aspirator may vary, and cut away in the upper right area to show the charging hopper gate.

The detailed construction of aspirator 10 is shown in FIGS. 2 and 3. With reference to FIG. 2, aspirator 10 has a granular material charging inlet 30, a charging hopper 31 and a discharge means 32 for conducting granular material, G, into and from separation plenum 33. Separation plenum 33 extends typically about four feet vertically downwardly and is adapted to conduct granular material, G, from charging hopper outlet lip 34 vertically downwardly to discharge means 32. Gate means 35 is disposed at the outlet from charging hopper 31, and gate means 36 is disposed at discharge means 32.

Separation plenum 33 defines six air inlets 40, which are vertically spaced as shown in FIG. 2, and horizontally extending, as shown in FIG. 3, across the entire width of separation plenum 33. A corresponding number (six) of vertically spaced, horizontally extending air outlets 41 is provided on the side wall of separation plenum 33 opposite air inlets 40. Air outlets 41 are disposed opposite and above the respective corresponding air inlet 41, as shown in FIG. 2.

An exhaust or air outlet manifold 42 extends from the lowermost separation plenum air outlet 41 to the uppermost air outlet 41, the full width of aspirator 10, and includes air discharge conduit 11. Air outlet manifold 42 communicates with each of the air outlets 41 to conduct air and suspended fines and foreign matter, F, from separation plenum 33, through air outlets 41, and through air outlet manifold 42 and out of aspirator 10 at discharge conduit 11.

Air inlets 40 are each formed with an air inlet lip 45 which depends from the side wall of separation plenum 33 opposite air outlet manifold 42 at the lower periphery 46 of each of the air inlets 40, and extends upwardly and away from separation plenum 33, terminating below the upper periphery 47 of air inlets 40. A cooperating separation plenum inlet lip 48 depends from the side wall of separation plenum 33 opposite air outlet manifold 42 at the upper periphery of each of the vertically spaced air inlets 40, extending downwardly and into separation plenum 33, terminating above the lower periphery 46 of air inlet passages 40.

Air outlets 41 include a separation plenum outlet lip 49 which depends from the sidewall of separation plenum 33 adjacent air outlet manifold 42 at the upper periphery 50 of each of the vertically spaced air outlets 41, extending downwardly and inwardly into separation plenum 33, terminating above the air inlet passage 40 immediately below and opposite the corresponding air outlet passage 41, as shown in FIG. 2.

Gates 35 and 36 are gravity operated by the weight of granular material, G, bearing against the respective gates to swing them open against the closing force applied to the gates by arms 51 and 52, respectively. The closing force on gates 35 and 36 can be varied by adjusting the position of dead weights 53 and 54, respectively, to adjust the length of the lever arm through which the weights operate. Dead weight 54 should be adjusted on lever arm 52 of gate 36 to apply only enough closing force against the discharging stream of granular material, G, to leave an opening sufficiently wide to allow passage of substantially the entire stream of clean granular material, without causing an accumulation or build-up of material at the gate, thereby allowing maximum through-put, but simultaneously preventing communication between separation plenum 33 and the atmosphere.

It should be noted that separtion plenum 33 extends vertically downwardly from the lip 34 of charging hopper 31 to discharge means 32, thereby providing for a vertical drop or flow of granular material. Separation plenum inlet lips 48 and separation plenum outlet lips 49 extend into separation plenum 33 but terminate before encroaching upon a vertical drop zone that is about one-half inch wide, that is, the horizontal distance from the termination of separation plenum inlet lips 48 and the termination of separation plenum outlet lips 49 is about one-half inch. This allows a substantial portion of the flow of granular material, G, to drop freely, unimpeded, vertically downwardly for maximum throughput. To the extent that the flow path of granular material, G, exceeds approximately one-half inch in thickness, lips 48 and 49 impede the vertical drop, and deflect the excess thickness plenum 33 avoids the substantial zig-zag flow path and bunching, congregating and recompaction of the prior art aspirators. Separation plenum 33 provides for a substantially unimpeded free drop of granular material, G, from the lip 34 of charging hopper 31 to discharge means 32, for maximum throughput and separation efficiency.

Method and Operation

The method of the present invention separates the fines and foreign matter, F, from the uncleaned, dry, free-flowing granular material, G, by dropping the granular material, G, in a vertical drop or flow path, as shown in FIG. 2, from the lip 34 of charging hopper 31 to discharge means 32. An opposing, substantially upward air stream is provided in the flow path throughout substantially its entire length, to thereby suspend the fines and foreign matter, F, in the air stream. The upward air stream is provided by creating an air pressure gradient between inlets 40 and outlets 41 of separation plenum 33, thereby causing air flow into inlets 40 and out outlets 41. The positioning of the outlets 41 above each corresponding inlet 40 results in an upward air stream opposing the downward drop or flow of granular material, G, as shown at arrows $A_V$ in FIG. 2. The velocity of the upward air stream can be adjusted by varying the pressure gradient. A plurality of vertically spaced, substantially horizontal air streams is also provided, extending transversely across the vertical flow path of granular material, G, as shown at arrows $A_H$ in FIG. 2. The opposing air stream, $A_V$, and transverse air streams, $A_H$, suspend the fines and foreign matter, F, in separation plenum 33 and conduct it from the flow path of the granular material, G, through separation plenum air outlets 41, into manifold 42 and out discharge conduit 11. The suspended fines and foreign material are thus conducted from the flow path of the granular material by a pluraliyy of vertically-spaced, substantially-horizontal air streams, $A_H$, flowing from air inlets 40, transversely across the flow path of granular material, G, upwardly and out of separation plenum 33 at each corresponding separation plenum air oulet 41 offset from the flow path in the direction of air stream, $A_H$, above the corresponding air inlet 40. The clean granular material, G, is then collected at discharge means 32 for discharge from aspirator 10.

For optimum efficiency in suspension and separation of fines and foreign matter, the opposing upward air stream $A_V$, should be in the range of 600–1200 fpm; the stream, transverse, substantially horizontal component should be in the range of 800–2200 fpm; and the air stream from separation plenum through air outlets 41 and air outlet manifold 42, and out discharge outlet 11 should be in the range of 1000–2400 fpm.

Grain aspirator 10 can be used in an open system shown in FIG. 1 or in a closed system shown in FIG. 4. In the closed system of FIG. 1, the air outlet manifold 42 of aspirator 10 is connected through air discharge conduit 11 to a conventional cyclone-type dust collector 12. Activation of blower 14 by motor 15 draws clean air from the atmosphere into air inlets 40 and through separation plenum 33, as explained above with reference to FIG. 2, and out air outlet manifold 42, through discharge conduit 11 and into dust collector 12. The fines and foreign matter settle in dust collector 12 for discharge and disposal. The relatively clean air leaves dust collector 12 through conduit 13 and can be filtered and discharged to the atmosphere. Unclean granular material is fed through aspirator inlet 30, is cleaned as it drops through separation plenum 33 and clean granular material is discharged from aspirator 10 at discharge means 32.

In the closed system of FIG. 4, air is continuously recirculated with substantially no air discharge to the atmosphere as air laden with suspended fines and foreign material leaves aspirator 10 through discharge conduit 11 and settles in settling chamber 20. The fines and foreign matter settle to the bottom of chamber 20 for removal by screw conveyor 22. Filter 21 filters the air for passage through blower 23, around baffle plate 24 and into air inlets 40 of aspirator 10. The separation process occurs in separation plenum 33 as explained above.

The grain aspirator 10 of the present invention can be used for removal of hazardous fines from grain, for recovering foreign matter and discharge from grain, for removal of infestation and fragments, for separating fines, angel hair and snake skins from plastic pellets and to remove paper from reground plastic bottles. It can also be used to remove hulls from oats, cracked soy beans and soybean meal. It is also useful for removal of fines and cooling following roasting, removal of fines from fertilizer and other chemicals and to reclaim and salvage material, thereby upgrading it for sale.

The throughput capacity of the aspirator is 100–825 bushels per hour of granular material per foot of width of aspirator 10.

The number of air inlets and outlets and resulting transverse air streams may vary in the range of two to twenty, with six shown in the preferred embodiment.

Having thus described our invention, we claim:

1. A vertical-drop aspirator for separating fines and/or foreign matter from dry, free-flowing, granular material, which comprises:

a. a charging hopper, b. discharge means for conducting said granular material from said aspirator, disposed substantially vertically beneath said charging hopper, c. a separation plenum formed by spaced side walls and spaced end walls contiguous with said side walls extending vertically downwardly from said charging hopper to said discharge means, and adapted to communicate with said charging hopper and said discharge means, to thereby conduct said granular material from said charging hopper vertically downwardly in an unimpeded, free-fall, vertical flow path to said discharge means, d. an air outlet manifold extending substantially the entire length of said separation plenum adjacent one side wall thereof, e. a plurality of horizontally-extending, vertically-spaced air inlets formed in the side wall of said separation plenum opposite said air outlet manifold, providing inlets into said separation plenum, f. a corresponding plurality of horizontally-extending, vertically-spaced air outlets formed in the side wall of said separation plenum opposite said air inlets and adjacent said air outlet manifold, providing outlets from said separation plenum to said air outlet manifold and disposed opposite and above said air inlet passages, respectively, and g. a separation plenum outlet lip depending from said side wall of said separation plenum adjacent said air outlet manifold at the upper periphery of each of said vertically-spaced air outlets, extending downwardly and into said separation plenum and terminating above and spaced horizontally from said air inlet passage immediately below and opposite said air outlet passage.

2. The aspirator of claim 1 and a separation plenum inlet depending from said side wall of said separation plenum opposite said air outlet manifold at the upper periphery of each of said vertically-spaced air inlets, extending downwardly and into said separation plenum and terminating below and spaced horizontally from said separation plenum outlet lip above the lower periphery of said air inlet passage.

3. The aspirator of claim 2 and an air inlet lip depending from side wall of said separation plenum opposite said air outlet manifold at the lower periphery of each of said air inlets, extending upnwardly and terminating below the upper periphery of said air inlet passage.

4. The aspirator of claim 1 and an air inlet lip depending from said side wall of said separation plenum opposite said air outlet manifold at the lower periphery of each of said air inlets, extending upwardly and terminating below the upper periphery of said air inlet passage.

5. The aspirator of claim 4 and gate means disposed between said charging hopper and the upper end of said separation plenum for preventing communication between said separation plenum and said charging hopper except for the flow of said granular material.

6. The aspirator of claim 1 and gate means disposed between said charging hopper and the upper end of said seperation plenum for preventing communication between said separation plenum and said charging hopper except for the flow of said granular material.

7. The aspirator of claim 6 and gate means disposed below said discharge means for preventing communication between said collection hopper and the atmosphere except for the flow of said granular material.

8. The aspirator of claim 13 and gate means disposed below said discharge means for preventing communication between said discharge means and the atmosphere except for the flow of said granular material.

9. A method of seperating fines and/or foreign matter from dry, free-flowing, granular material which comprises a. dropping the material in an unimpeded, free-fall vertical flow path, b. providing an opposing, substantially-upward air stream in said flow path throughout substantially the entire length of said flow path, to thereby suspend said fines and/or foreign matter in said air stream, c. providing a plurality of vertically-spaced, substantially-horizontal air streams extending transversely across said flow path, d. conducting the suspended fines and foreign matter from said flow path at a corresponding plurality of spaced points above the plurality of vertically-spaced, substantially-horizontal air streams, respectively, and offset from said flow path in the direction of said substantially-horizontal air stream immediately beneath each of said points, and e. collecting the separated granular material, free of said fines and/or foreign matter, in said flow path below said air streams

10. The method of claim 9 wherein said opposing, substantially upward air stream has a velocity in the range of 600 to 1200 feet per minute.

11. The method of claim 10 wherein said vertically-spaced, substantially horizontal air streams have a velocity in the range of 800 to 2200 feet per minute.

12. The method of claim 9 wherein said vertically-spaced substantially horizontal air streams have a velocity in the range of 800 to 2200 feet per minute.

13. The method of claim 12 wherein said suspended fines and foreign matter are conducted from said flow path at a velocity in the range of 1000 to 2400 feet per minute.

14. The method of claim 9 wherein said suspended fines and foreign matter are conducted from said flow path at a velocity in the range of 1000 to 2400 feet per minute.

* * * * *